US006364416B1

(12) United States Patent
Rheault et al.

(10) Patent No.: US 6,364,416 B1
(45) Date of Patent: Apr. 2, 2002

(54) MULTI-FUNCTION ARTICLE OF FURNITURE

(75) Inventors: Alan E. Rheault, Grand Rapids, MI (US); Robert M. Scheper, Greensboro, NC (US); George J. Simons, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/528,412

(22) Filed: Mar. 17, 2000

(51) Int. Cl.[7] ..... A47C 16/02

(52) U.S. Cl. ..... 297/423.41; 297/452.17; 297/461; 5/652

(58) Field of Search ..... 297/423.39, 423.41, 297/452.17, 461; 5/630, 633, 636, 652

(56) References Cited

U.S. PATENT DOCUMENTS

| | | | | | |
|---|---|---|---|---|---|
| 2,509,395 | A | | 5/1950 | Madan | |
| 2,552,693 | A | | 5/1951 | Smith | |
| 2,866,497 | A | | 12/1958 | Struthers | |
| 3,002,789 | A | | 10/1961 | Brown | 297/462 |
| 3,009,172 | A | * | 11/1961 | Eidan | 5/636 X |
| 3,139,632 | A | * | 7/1964 | Johns | 5/652 X |
| 3,230,909 | A | | 1/1966 | Watson | 108/150 |
| 3,230,910 | A | | 1/1966 | Olsson | 108/153 |
| 3,992,733 | A | * | 11/1976 | Racine | 5/652 |
| 4,208,072 | A | | 6/1980 | Iskendarian | 297/440 |
| 4,544,598 | A | | 10/1985 | Meiller et al. | 428/246 |
| D305,850 | S | | 2/1990 | Peterson et al. | D7/608 |
| 5,035,015 | A | * | 7/1991 | Maietta | 5/630 |
| 5,148,563 | A | * | 9/1992 | Klearman et al. | 5/652 |
| 5,634,223 | A | | 6/1997 | Obermaier | 5/654 |
| 5,638,564 | A | | 6/1997 | Greenawalt et al. | 5/636 |
| 5,754,998 | A | | 5/1998 | Selton | 5/652 |
| D406,470 | S | | 3/1999 | Lin | D6/349 |
| 5,910,080 | A | | 6/1999 | Selton | 5/652 |
| D419,340 | S | | 1/2000 | Swensson et al. | D6/486 |
| 6,141,807 | A | * | 11/2000 | Tapper | 5/562 X |

OTHER PUBLICATIONS

Intrex Monoforms, "Monoforms," p. 15 bearing a designation of "(c) 1984" (1 sheet).

U.S. application No. 29/120,447, titled "Article of Furniture" filed Mar. 17, 2000, including specification, claim and drawings (3 sheets).

* cited by examiner

*Primary Examiner*—Peter R. Brown
(74) *Attorney, Agent, or Firm*—Foley & Lardner

(57) ABSTRACT

An article of furniture is disclosed. The article of furniture includes a multi-purpose article of furniture for use by at least one worker in a work environment having a horizontal support surface such as a floor and at least one vertical support surface such as a wall. The article includes a core formed by a first core section coupled to a second core section at an angular displacement and a cover configured to fit around the core. The core can be oriented in a first position for a first purpose and a second position for a second purpose. The article may be stored adjacent another article of furniture in a first arrangement and in use adjacent another article of furniture in a second arrangement. The article may also be a pocket for storing items attached to a covering skin. The covering skin may include a marking identifier.

114 Claims, 5 Drawing Sheets

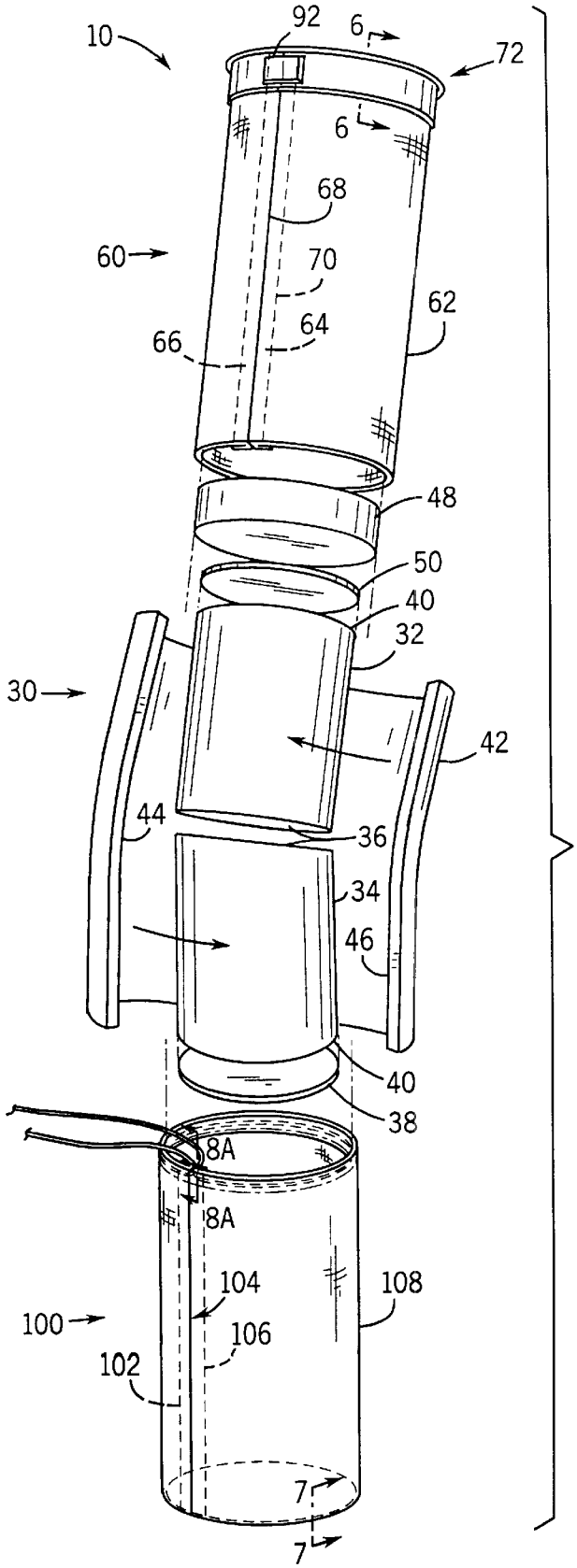
FIG. 4
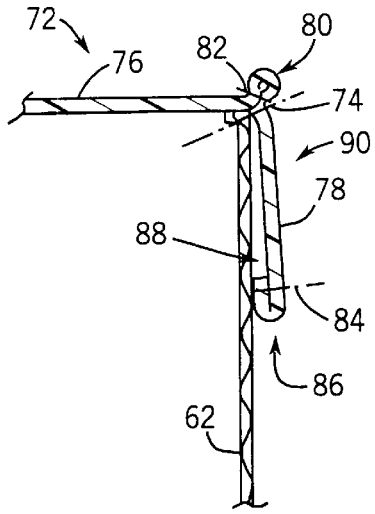
FIG. 6
FIG. 7
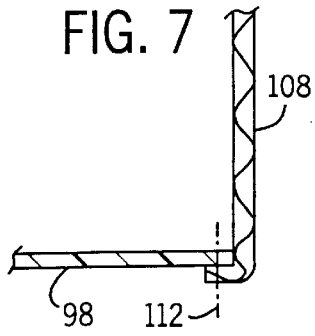

MULTI-FUNCTION ARTICLE OF FURNITURE

CROSS-REFERENCE TO RELATED APPLICATIONS

The following U.S. patent application is cited by reference and incorporated by reference herein: Ser. No. 29/120,447 titled "ARTICLE OF FURNITURE" commonly assigned and filed on Mar. 17, 2000.

FIELD OF THE INVENTION

The present invention generally relates to an article of furniture for use in a work environment. In particular, the present invention relates to a multi-function article of furniture that can be used as a seating product, as support, as a work surface, or in any of a wide variety of other arrangements.

BACKGROUND OF THE INVENTION

It is well known to provide an article of furniture for supporting a worker in a work environment. Seating products such as chairs for supporting a worker in a seated position are generally well-known. Typically a chair will include a base (or legs), a seat and a back. However, such known chairs comfortably support a worker only in a single posture (i.e., a single seated position). Alternative seating products, such as "bean-bag" chairs or the like are known but not commonly thought of as comfortable (or aesthetically suitable for the work environment), even though multiple postures may be supported. It is also known to provide for a stool, which will support a single posture (i.e., a seated position).

It is also generally well-known to provide an article of furniture that functions as a support. For example, it is well-known to use a stool such as a foot stool for supporting the feet of a worker. Known foot stools typically have a relatively small height (i.e., lower than the lap of a worker when in a seated position). Such known footstools are usually used in association with a chair, such that a worker sitting in the chair can rest his or her feet on the stool (i.e., below the seat of the chair). Such known stools may also be used to support a worker in a seated position (i.e., sitting on the stool or resting on a floor against the stool). However, such known stools provide only a limited number of seating positions at a limited number of heights (e.g., seated on top of the stool, or seated on the floor and resting against the stool). Moreover, such known articles of furniture are not typically capable of a multi-function use.

Accordingly, it would be advantageous to provide an article of furniture for multi-function use in a work environment, for example as a seating product to support a worker in a variety of positions at a variety of heights, as a support, as a work surface, etc. It would further be advantageous to provide a multi-function article of furniture that may be formed in a variety of sizes and shapes and that may be easily transported between work areas. Other advantages of the subject matter recited in the appended claims will become apparent to those skilled in the art upon review of the specification and the claims.

SUMMARY OF THE INVENTION

The present invention relates to a multi-purpose article of furniture for use by at least one worker in a work environment having a horizontal support surface such as a floor and at least one vertical support surface such as a wall, including a core formed by a first core section coupled to a second core section at an angular displacement, and a cover configured to fit around the core. The core can be oriented in a first position for a first purpose and a second position for a second purpose.

The present invention also relates to a seating product selectively positionable between a vertical orientation along a vertical axis and a horizontal orientation along a horizontal axis in a work environment or the like providing a horizontal surface such as a floor and a vertical surface such as a wall. The seating product includes a semi-rigid core having a first generally cylindrical portion coupled to a second generally cylindrical portion thereby forming an oblique portion relative to the vertical axis, a generally planar end cap coupled to the first portion of the core, the end cap being inclined relative to the horizontal axis, and a generally planar base coupled to the second portion generally parallel to the horizontal axis. The core in both the vertical orientation and the horizontal orientation is configured to support at least one worker.

The present invention also relates to an article of furniture selectively positionable between an upright orientation and a horizontal orientation for use in a work environment or the like having a horizontal support surface such as a floor and a vertical support surface such as a wall. The article of furniture includes a core having a generally planar side and a first end configured for resting on the horizontal support surface and a second end being oblique relative to the first end and configured for supporting a worker, a curved portion disposed between the first end and the second end of the core, a generally planar base for supporting the core in the upright orientation coupled to the first end of the core, and a generally planar cap coupled to a second end of the core. The planar side of the core is configured to rest against the horizontal surface or the vertical surface to selectively retain the core in either a first horizontal position or a second horizontal position.

DESCRIPTION OF THE FIGURES

FIG. 4 is an exploded perspective view of the article of furniture.

FIG. 6 a fragmentary cross-sectional view of the article of furniture taken along line 6—6 of FIG. 4.

FIG. 7 is fragmentary a cross-sectional view the article of furniture taken along line 7—7 of FIG. 4.

DETAILED DESCRIPTION OF THE PREFERRED EMBODIMENTS

Figure 1:
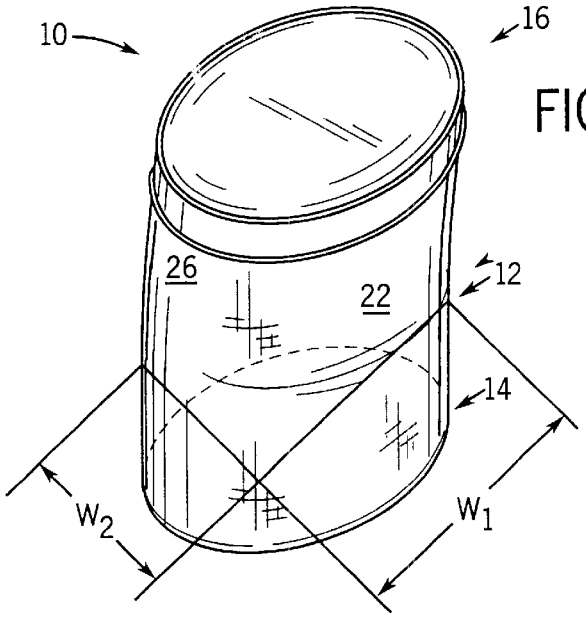
FIG. 1 is a front perspective view of a multi-function article of furniture according to an exemplary embodiment of the present invention.

Referring to FIG. 1, a multi-function article of furniture (shown in an exemplary configuration as an article 10) for use in a work environment is shown according to exemplary embodiment of the present invention. Article 10 includes a curved or "bent" transition portion (shown as a "kink" 12) intermediate a base portion 14 and an end cap 16. Article 10 includes a face section shown as a front 22 (see FIGS. 2 and 3) having a width $W_1$ greater than a width $W_2$ of a side section 26, such that article 10 provides an elongate "footprint" (shown as an oval). It should be noted that according to alternative embodiments, the article could provide any of a wide variety of other footprints of any of a variety of other shapes, sizes and proportions (including wholly or partially circular or rectilinear or combinations thereof).

The construction of article 10 is shown in FIG. 4. Article 10 includes a core shown as a body 30 having a generally cylindrical shape. An upper section (shown as a wedge 32) of body 30 is attached to a lower section (shown as a wedge 34) by a fastener (shown in FIG. 5 as an adhesive 20). Each of wedges 32 and 34 include an angled surface (shown as an oblique end 36), which is inclined relative to a generally planar base plate 38 that supports wedge 34. Each of wedges 32 and 34 include a planar end 40, which is generally parallel to base plate 38, opposite oblique end 36. Base plate 38 is attached to wedge 34 by a fastener shown as adhesive 20 (see FIG. 5).

Figure 9:
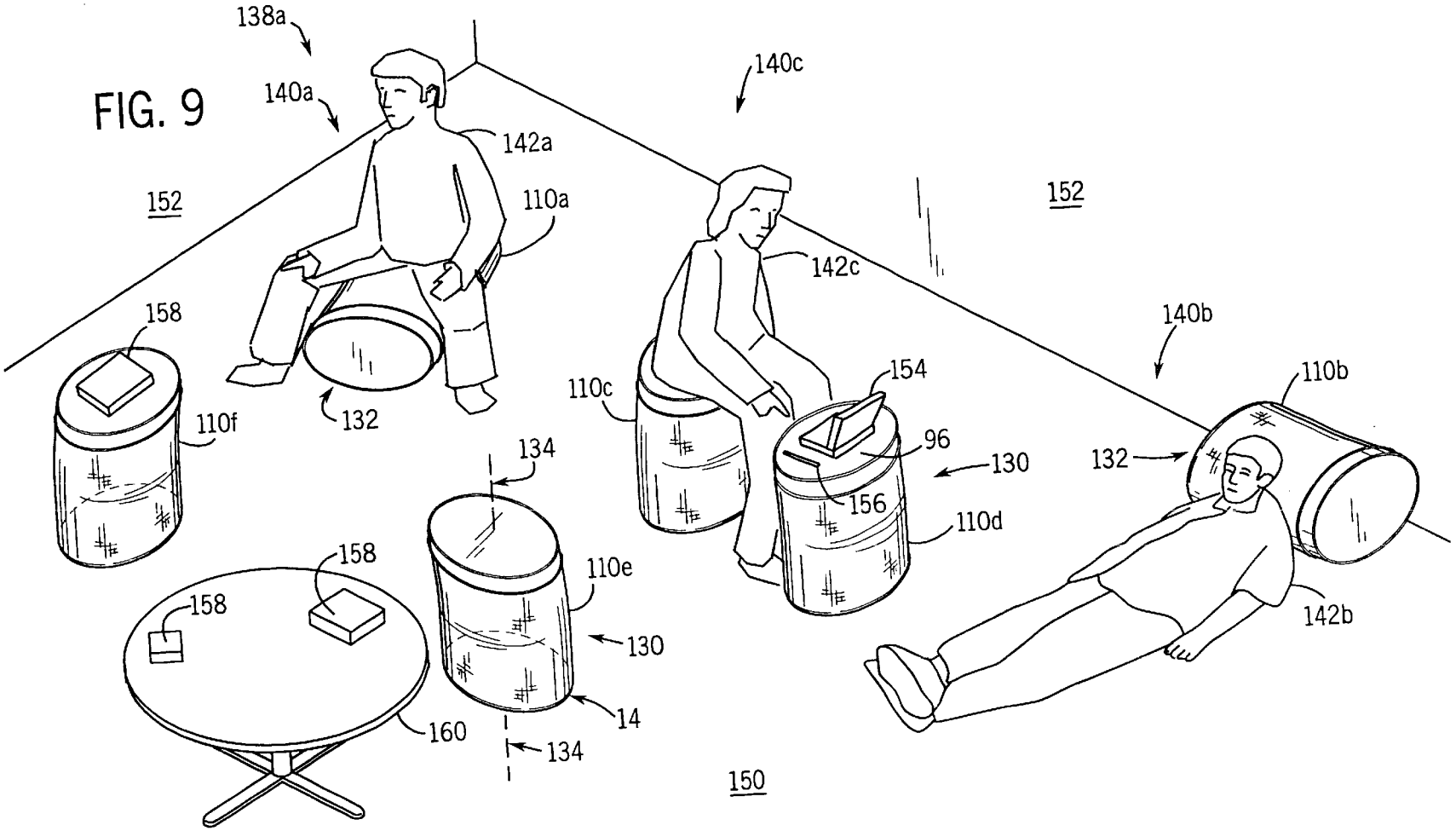
FIG. 9 is a schematic view of a work environment showing multiple articles of furniture used in multiple exemplary functions according to an exemplary embodiment of the present invention.

The attachment of oblique end 36 of wedge 32 to oblique end 36 of wedge 34 forms kink 12. Oblique end 36 is inclined from vertical by angle $A_1$, which is preferably in the range of about 2 to 8 degrees relative to base plate 38, more preferably in the range about 3 to 5 degrees, most preferably at about 4 degrees. When oblique end 36 of wedge 32 is attached to oblique end 36 of wedge 34, body 30 is inclined from horizontal by angle $A_2$, which is preferably in the range of about 4 to 12 degrees, more preferably in the range of about 6 to 10 degrees, most preferably at about 8 degrees. According to alternative embodiments, the kink may be an angle or a curve. According to any preferred embodiment, the article has an offset or displacement between the upper section (e.g. wedge) and the lower section (e.g., wedge). Kink 12 provides a in convenient location for supporting a portion of a worker (e.g., head, arm, foot, leg, back, etc.). For example, a worker may rest his or her head against kink 12 (as shown in FIG. 9). Also, kink 12 provides a work surface 96 of article 10 that is inclined relative to a horizontal surface such as a floor (as shown in FIG. 9) for ergonomic positioning (e.g. writing). According to a preferred embodiment, the core is made of a semi-rigid, lightweight material (e.g., structural foam such as polystyrene). According to an alternative embodiment, the core may be a unitary piece made of molded styrofoam or other semi-rigid material, or from combinations of two, three or more pieces of material (which may be solid or hollow) in various suitable shapes that provide a core of suitable strength and rigidity. According to other alternative embodiments, the core can be reinforced with rigidifying members (e.g., structural steel, plastic, rebar, etc.) or other structures or materials.

Referring further FIG. 4, a cushion layer (shown as a wrap 42) circumscribes and surrounds body 30. Wrap 42 includes a left end 44 in an abutting relationship to a right end 46. The wrap is preferably made of a semi-rigid material such as foam. A generally rigid plate (show shown as a disk 50) is attached to wedge 32 by adhesive 20 (see FIG. 5). A flexible cushion (shown as a foam pad 48) is attached to disk 50 and wrap 42.

An interior covering (shown as a skin 60) encapsulates body 30 as shown in FIG. 4. Skin 60 is generally tubular shaped and includes a reinforcing layer 62 coaxial with body 30. Reinforcing layer 62 functions to compress the components of body 30 in a tight relationship to inhibit shifting, and also functions to protect pad 48 and wrap 42 from wear. Reinforcing layer 62 includes left end 66 attached to right end 64 by an abutting seam 68. A fastener (shown as stitching 70) may further attach a left end 66 to a right end 64. Referring to FIG. 6, a rim 72 it is shown attached to reinforcing layer 62 by a fastener (shown as a stitch 74). Rim 72 includes a top wall 76 generally parallel to base plate 38 and a side wall 78 generally parallel to reinforcing layer 62. A length of top wall 76 may be folded onto itself and secured with a fastener (shown as a stitch 82) to form a reinforcing bead 80. In a similar manner, side wall 78 may be folded onto itself and secured with a fastener (shown as a stitch 84) to form a reinforcing bead 86.

Referring further to FIG. 6, an interior cavity 88 is located between reinforcing layer 62 and side wall 78. Cavity 88 may function as a handle for moving or positioning article 10. To reposition article 10, a worker may insert his or her fingers within cavity 88 and lift article 10 between work areas. According to a preferred embodiment as shown in FIG. 6, bead 86 is not necessarily directly attached to reinforcing layer 62, such that side wall 78 may be selectively positionable between a use position 90 (i.e., side wall 78 "folded" over an exterior covering shown as a "sock" 100) and an extended position (not shown) for grasping, lifting or dragging article 10.

Figure 5:
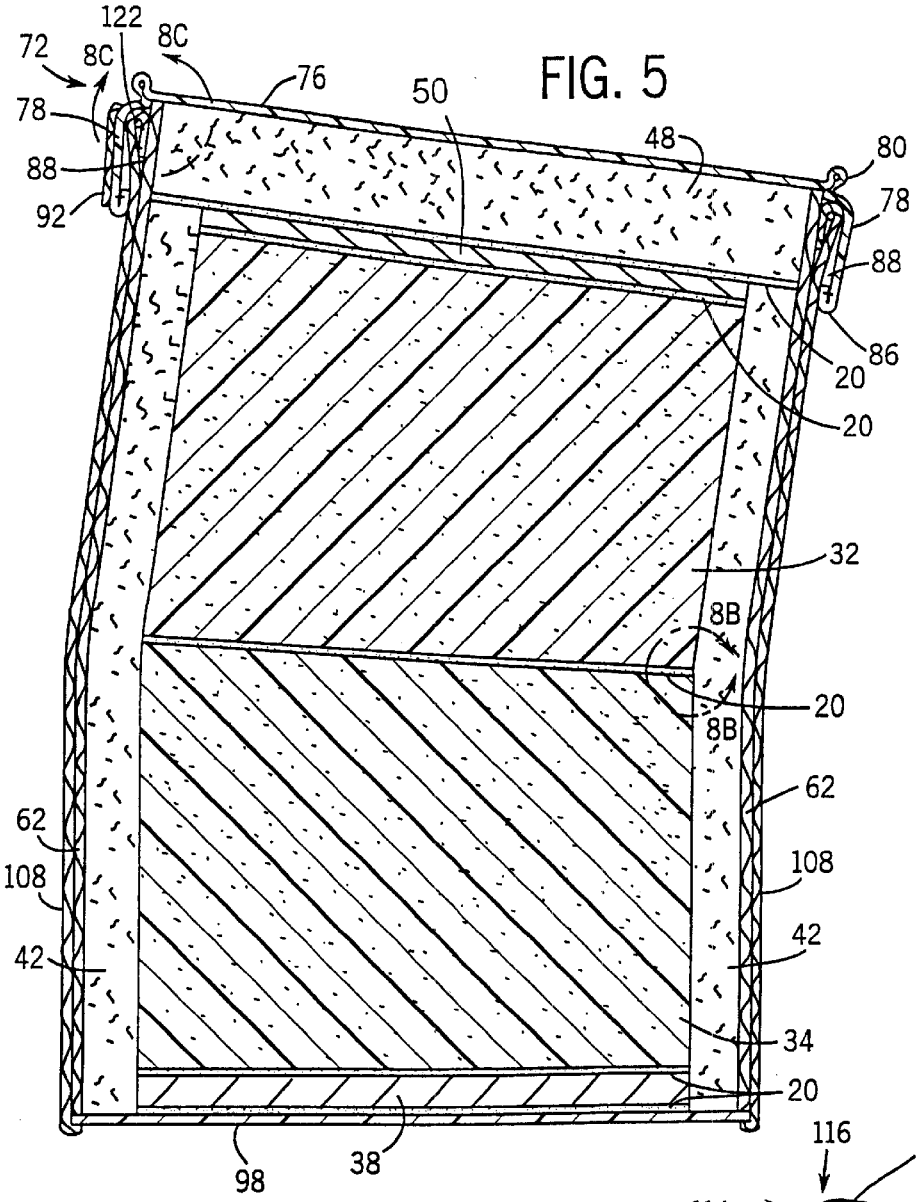
FIG. 5 is a cross-sectional view of the article of furniture taken along line 5—5 of FIG. 3.

The exterior covering or sock 100 encapsulates body 30 and skin 60 as shown in FIG. 4. Sock 100 is generally tubular shaped and is coaxial with body 30. Sock 100 functions to protect pad 48 and wrap 42 from wear or soiling, and is easily removable from body 30 for cleaning. Sock 100 includes a seam 104 having a stitched left end 102 that abuts against a stitched right end 106. A fastener (shown as stitches) assists in attaching left end 102 to right end 106. A side wall 108 of sock 100 is generally parallel to reinforcing layer 62. A base wall 98 of sock 100 is attached by a fastener (shown as a stitch 112) to side wall 108. Base wall 98 is generally perpendicular to side wall 108 and supports body 30. According to a preferred embodiment as shown in FIG. 5, sock 100 may be pulled (or drawn) under rim 72 of lid or end cap 16 and inside cavity 88 near bead 80. According to an alternative embodiment, the sock may butt against the lower end of the lid (e.g. bead 86).

Figure 8B:
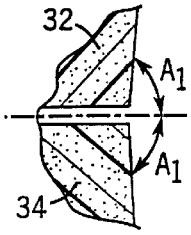
FIG. 8B is a fragmentary cross-sectional view of the article of furniture taken along line 8B—8B of FIG. 5.
Figure 8C:
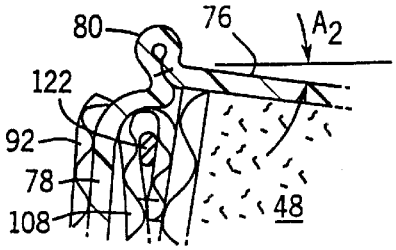
FIG. 8C is a fragmentary cross-sectional view of the article of furniture taken along line 8C—8C of FIG. 5.
Figure 8A:
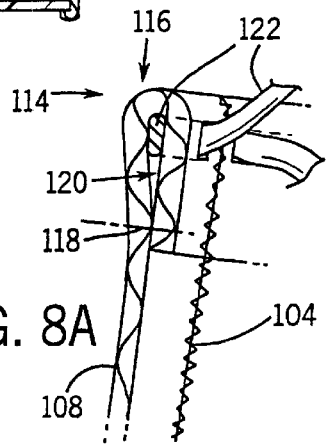
FIG. 8A is a fragmentary cross-sectional view of the article of furniture taken along line 8A—8A of FIG. 5.

Referring to FIG. 8A, sock 100 includes a tightening mechanism 114 for securing sock 100 around body 30. Tightening mechanism includes side wall 108, which is shown folded onto itself and attached by a fastener (shown as a stitch 118) to form a fold 116. Fold 116 includes a cavity 120 for housing an elongate flexible member (shown as a drawstring 122). Drawstring 122 may be tightened to secure sock 100 around skin 60 and body 30. According to a preferred embodiment as shown in FIG. 4, a labeling surface (shown as a hangtag 92) may be attached to side wall 78 of rim 72. The labeling surface and the exterior cover (i.e., sock) may include indicia (e.g., color, text, etc.) for a functional purpose (e.g., to indicate the source or ownership of the article) or a decorative purpose (e.g., to "match" the color or pattern of the walls or floor of the work space).

Figure 2:
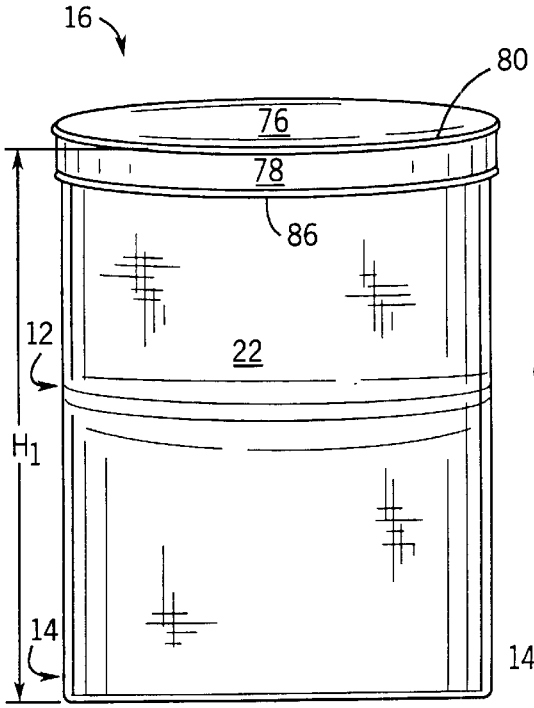
FIG. 2 is a front elevation view of the article of furniture.
Figure 3:
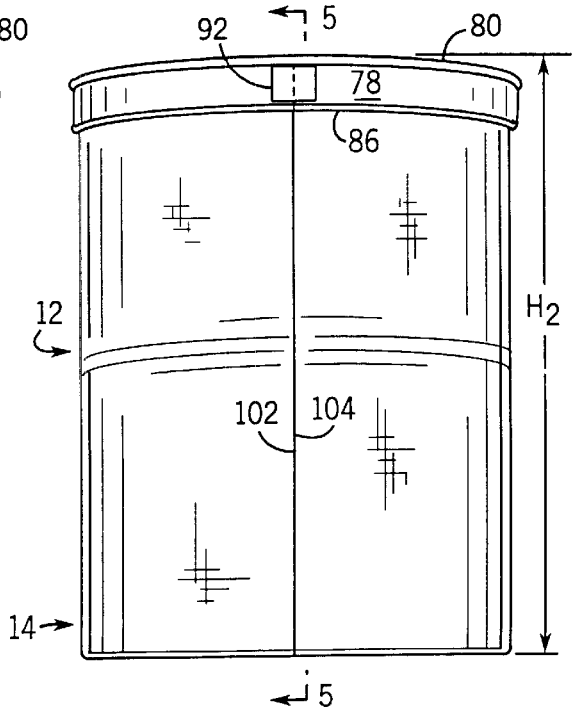
FIG. 3 is a rear elevation view of the article of furniture.
Figure 10:
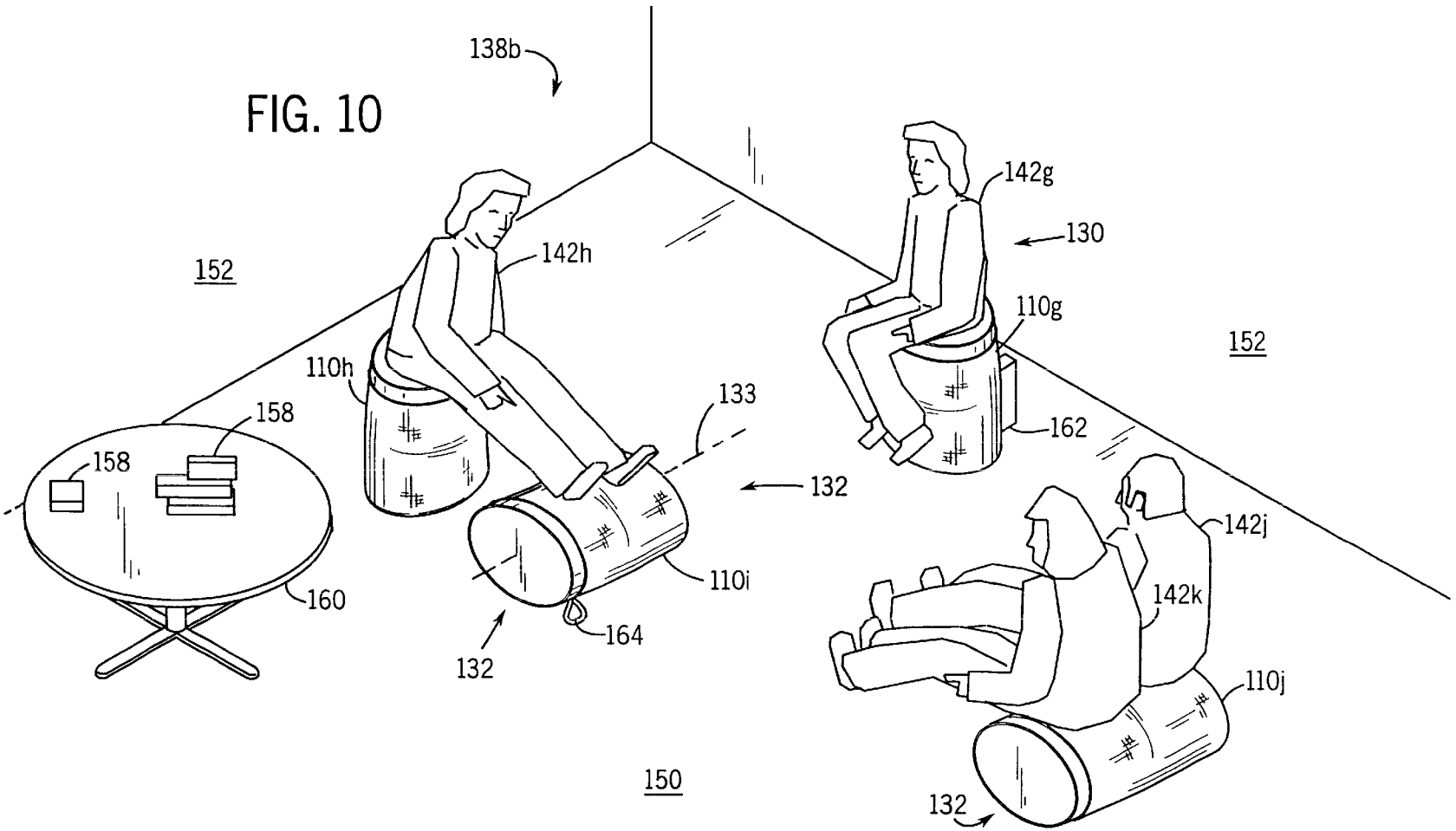
FIG. 10 is a schematic view of a work environment showing multiple articles of furniture used in multiple functions according to an exemplary embodiment of the present invention.

Article 10 is selectively repositionable between a variety of positions and orientations such as a vertical orientation 130 along a vertical axis 134 and a horizontal orientation 132 along a horizontal axis 133 (see FIGS. 9–10). As shown in FIGS. 1–3, heights $H_1$ and $H_2$ of article 10 are greater than width $W_1$, which is greater than width $W_2$. Accordingly, a worker may be supported by article 10 at different heights relative to a floor 150. For example, a worker perched on article 10 in vertical orientation 130 could be positioned at a distance of height $H_1$ or $H_2$ relative to floor 150, and a worker seated on article 10 in horizontal orientation 132 could be positioned at a distance of width $W_1$ or $W_2$ relative to floor 150.

A worker may use the multi-function article of furniture, alone or in combination with any other articles of furniture (e.g. single or multi-function) and/or in a variety of orientations for a variety of purposes. As shown in FIGS. 9—10, the articles may cooperate with other mobile and/or fixed articles of furniture to allow reconfiguration of work spaces, work areas and work stations for use by individual workers or groups of workers (who may be engaged in group, public, semi-private or private activities). FIG. 9 shows multiple multi-function articles of furniture used by workers for a variety of purposes in a work space 138*a*, and FIG. 10 shows workers in a work space 138*b* using a variety of multi-function articles of furniture positioned in a variety orientations. According to alternative embodiments, the article may be used in a confined work area (e.g., cashier stand, ticket booth, phone booth, etc.) or an open work area.

Referring to FIG. 9, a worker 142*a* in a work area 140*a* of work space 138*a* is shown straddling an article 110*a*, substantially identical to article 10 and having like reference numerals to identify like elements. Front 22 of article 110*a* is shown resting on floor 150. Width $W_1$ of front 22 is greater than width $W_2$ of side 26, such that article 110*a* resists rolling onto side 26 when article 110*a* is in horizontal orientation 132, and a worker seated on article 110 is at a distance of width $W_2$ from floor 150. According to an alternative embodiment, the side of the multi-function article of furniture in the horizontal orientation can be supported by the floor and straddled by a worker so the worker seated on the article is at a distance of width $W_1$ from the floor. According to other alternative embodiments, the width of the front of the article may be reduced so the article in the horizontal orientation may easily be rolled along a horizontal surface such as a floor.

The article may support a worker in a non-seated or alternative posture position. In FIG. 9, a worker 142*b* is shown in a work area 140*b* resting in a prone position against an article 110*b*. Article 110*b* is shown in horizontal orientation 132 wedged between worker 142*b* and a wall 152. According to alternative embodiments, a worker may use the multi-function article of furniture to hold up any part of the body of the worker (e.g., head, back, arms, legs, etc.). Referring further to FIG. 9, a worker 142*c* is shown in a work area 140*c* perched on an article 110*c* in vertical orientation 130. An accessory (shown as a notebook computer 154) rests on work surface 96 of an article 110*d*. Work surface 96 may support other accessories such as a keyboard (and shown as a book 158 and a pen 156) or for providing a generally planar surface for writing or taking notes. According to a preferred embodiment as shown in FIG. 9, base portion 14 rests on floor 150 when article 110*d* is in vertical orientation 130. According to other alternative embodiments, the orientation of the article of furniture may be reversible (e.g., the end cap may be supported by the floor and the work surface may support a worker or an accessory).

Referring further to FIG. 9, multi-function article 110*e* and multi-function article 110*f* are shown in work area 140*b* associated with other articles of furniture commonly thought of as having a single-function (e.g., chair, file drawer, desk, etc., and shown as a table 160), which may support other accessories. A worker may be associated with the multi-function article by, for example, marking it with indicia (e.g., text, color, etc.) or by keeping it in close proximity. Accordingly, worker 142*c* shown in FIG. 9 may be closely associated with article 110*c* by using it for seating in work area 140*c* and then carrying it to work area 140*a* for use with table 160.

The multi-function article of furniture may be used for a variety of other purposes. The article may be used alone for supporting a worker in the seated, prone or alternative position. For examples, a worker 142*g* in FIG. 10 is shown sitting on an article 110*g* in vertical orientation 130, and workers 142*j* and 142*k* are both shown seated on an article 110*j* in horizontal orientation 132, which functions as a bench. The article may be used alone to provide a work surface or a podium, or may be used alone as a footstool or a pillow. The multi-function article of furniture may also be used with other conventional articles of furniture such as panel wall systems, storage products, seating products, work stations, work surfaces, etc. For example, the article may be stowed under a table or a desk. The article may be placed near a display board mounted to a vertical wall to allow a worker to be supported by the article and use the display board. Also, the multi-function article of furniture may be used in combination with other like articles (of an identical or different size and/or shape). For example, multiple articles may be aligned in the vertical or horizontal orientation to provide a sofa or lounge. Also, as shown in FIG. 10, a worker 142*h* is shown seated on an article 110*h* and resting his or her feet on another like article 110*i* in horizontal orientation 132. Multiple articles may be placed in a work space for division into multiple work areas (e.g., physically and visually divide the work area for worker activity). Multiple articles may be used as a pedestal for a large horizontal work surface such as a display board.

According to a preferred embodiment, the exterior covering (i.e., sock) is made of a flexible and durable material (e.g., fabric, leather, vinyl, etc.). According to a particular preferred embodiment, the exterior covering is made of Fab Link Milliken Burgundy 5A20 fabric commercially available from Applied Textiles of Detroit, Mich., U.S.A. According to alternative embodiments, any of a wide variety of these or other materials may be used in any of a variety of combinations. According to a particularly preferred embodiment, the reinforcing layer is made of Nylon Spandex Raw material commercially available from Simil Cuero of Mexico City, Distrito Federal, Mexico. The lid is preferably made of vinyl (model number Vinyl Black 57B3) commercially available from Omnoval Gencorps of Columbus, Ohio, U.S.A. The labeling surface is preferably made of leather commercially available from Towsley's of Manitowoc, Wis., U.S.A. The elongate flexible member (i.e., drawstring) is preferably made of white polypropylene. The wrap is preferably made of plush 55 polyurethane foam (having dimensions of 1×26×46¾, 1.8/55 straight cut) commercially available from Foamex of Mexicali, Baja California, Mexico. The pad is preferably made of plush 55 polyurethane foam (having dimensions of 2.16⅞×12⅞, 2.5/45 pat top TS33) commercially available from Foamex of Mexicali, Baja California, Mexico. The lid and the wrap preferably have a density in the range of about 1.0 to 2.0 lbs./$ft^3$. The core is preferably made from white styrofoam (polystyrene) commercially available from Fanosa of Tijuana, Baja California, Mexico. The disk is preferably made of masonite particleboard having a thickness in the range of about between one-fourth to three-fourth inches commercially available from Ponderosa of Chihuahua, Chihuahua, Mexico. The base plate is preferably made from plywood or particleboard having a thickness of about three-quarter inches. The adhesive is preferably a hot melt adhesive (model no. Instaweld 34-3378) commercially available from Reichold of Charlotte, N.C., U.S.A. The multi-function article preferably has a height in the range of about 20–28 inches, more preferably about 24 inches. The article preferably has a width of about 15 inches, more preferably about 15.25 inches. The article preferably has a depth of about 22 inches.

It is important to note that the construction and arrangement of the elements of the multi-function article of furniture shown in the exemplary embodiments is illustrative only. Although only a few exemplary embodiments of the present invention have been described in detail in this disclosure, those skilled in the art who review this disclosure will readily appreciate that many modifications are possible in the exemplary embodiments (such as variations in sizes, structures, shapes and proportions of the various elements, values of parameters, mounting arrangements, use of materials, orientations, colors, combinations of shapes, etc.) without materially departing from the novel teachings and advantages of the invention. For example, according to an alternative embodiment as shown in FIG. 10, article 110*g* may be fitted with an interior or exterior pocket (shown as a saddle bag 162) for storing accessories. The lid of the article may be selectively removable from the body. The interior of the article may be partially hollowed or partitioned for storing accessories. As shown in FIG. 10, a handle 164 may be attached to the lid or exterior covering for easily repositioning the product or article in a work area. The core of the article may be unitary, or may include a plurality of structural components. The core may be cylindrical and/or may have an angular or bent profile. The core may be made of sculpted foam or other materials to provide for desired characteristics such as strength, weight, cost, etc. The reinforcing layer, rim and exterior covering may be made from any fabric such as polyester, cotton, nylon, polyester-cotton, black accord (model no. 19W1-250), etc. A variety of fasteners or fastening arrangements (e.g., adhesives, stitching, staples, tacks, etc.) as are known to those of skill in the art who may review this disclosure may be used to secure the components (e.g., sock and side wall) of the article together. Accordingly, all such modifications are intended to be included within the scope of the invention as defined in the appended claims.

Other substitutions, modifications, changes and omissions may be made in the design, operating conditions and arrangement of the preferred embodiments without departing from the spirit of the invention as expressed in the appended claims.

What is claimed is:

1. An article of furniture for use by at least one worker and selectively positionable between a vertical orientation along a vertical axis and a horizontal orientation along a horizontal axis in a work environment or the like providing a horizontal surface such as a floor and a vertical surface such as a wall comprising:

a semi-rigid core having a first generally cylindrical portion including an inclined surface coupled to an inclined surface of a second generally cylindrical portion thereby forming an oblique portion relative to the vertical axis;

a generally planar end cap coupled to the first portion of the core, the end cap being inclined relative to the horizontal axis;

a generally planar base coupled to the second portion generally parallel to the horizontal axis;

wherein the core in both the vertical orientation and the horizontal orientation is configured to support the at least one worker.

2. The article of furniture of claim 1 wherein the core further includes a face configured to rest on the horizontal surface when the seating product is in the horizontal orientation.

3. The article of furniture of claim 1 wherein the end cap is configured to support a worker and the base is configured to rest on the horizontal surface when the article of furniture is in the vertical orientation.

4. The article of furniture of claim 1 wherein the end cap is inclined relative to the horizontal axis in the range of between about 12–14 degrees.

5. A multi-purpose article of furniture selectively positionable between an upright orientation and a horizontal orientation for use in a work environment or the like having a horizontal support surface such as a floor and a vertical support surface such as a wall comprising:

a core having a side and a first end configured for resting on the horizontal support surface and a second end being oblique relative to the first end and configured for supporting a worker;

a curved portion disposed between the first end and the second end of the core;

a generally planar base for supporting the core in the upright orientation coupled to the first end of the core; and a generally planar cap coupled to a second end of the core;

wherein the side of the core is configured to rest against the horizontal surface or the vertical surface to temporarily retain the core in either the upright orientation or the horizontal orientation.

6. The article of furniture of claim 5 wherein the core has a generally oval-shaped cross-section.

7. The article of furniture of claim 5 further comprising a semi-rigid pad between the core and a covering skin.

8. The article of furniture of claim 7 further comprising a pocket for storing items attached to the skin.

9. The article of furniture of claim 7 wherein the covering skin further includes a marking identifier.

10. The article of furniture of claim 7 wherein the article of furniture is stored adjacent another article of furniture in a first arrangement and in use adjacent another article of furniture in a second arrangement.

11. A multi-purpose article of furniture for use by at least one worker in a work environment having a horizontal support surface such as a floor and at least one vertical support surface such as a wall comprising:

a core formed by a first core section having a generally cylindrical shape coupled at an angular displacement to a second core section having a generally cylindrical shape thereby forming a curved portion between the first core section and the second core section;

a cover configured to fit around the core;

wherein the core can be oriented in a first position for a first purpose and a second position for a second purpose.

12. The article of furniture of claim 11 wherein the first core section is a first wedge and the second core section is a second wedge.

13. The article of furniture of claim 11 wherein the first core section is directly coupled to the second core section.

14. The article of furniture of claim 11 wherein the core further includes a face configured to rest on the horizontal surface.

15. The article of furniture of claim 11 further comprising a semi-rigid pad between the core and the cover.

16. The article of furniture of claim 11 further comprising a base coupled to the first core section and a cap coupled to the second core section.

17. The article of furniture of claim 16 wherein the cap is configured for use as a work surface for supporting an accessory.

18. The article of furniture of claim 16 wherein the cap is configured for supporting a worker and the base is configured to rest on the horizontal surface.

19. The article of furniture of claim 11 wherein the first core section and the second core section are of the same general size and shape.

20. The article of furniture of claim 11 further comprising a handle coupled to the cover for readily repositioning the core within the work environment.

21. The article of furniture of claim 11 further comprising at least one rigid disc attached to the core and a flexible cushion disposed between the core and the rigid disc.

22. The article of furniture of claim 11 wherein the cover is made of a fabric material.

23. The article of furniture of claim 11 wherein the core is constructed of a semi-rigid, lightweight material.

24. The article of furniture of claim 11 wherein the core includes a structural foam.

25. The article of furniture of claim 11 wherein the generally cylindrical shape is oval.

26. The article of furniture of claim 11 wherein the generally cylindrical shape is elongate.

27. The article of furniture of claim 11 wherein the generally cylindrical shape is wholly circular.

28. The article of furniture of claim 11 wherein the generally cylindrical shape is partially circular.

29. The article of furniture of claim 28 wherein the generally cylindrical shape includes a first width greater than a second width.

30. The article of furniture of claim 29 wherein the generally cylindrical shape has an oval-shaped cross-section.

31. A multi-purpose article of furniture for use by at least one worker in a work environment having a horizontal support surface such as a floor and at least one vertical support surface such as a wall comprising:

a core formed by a first core section coupled to a second core section at an angular displacement thereby forming an offset between the first core section and the second core section;

a base configured for resting on the horizontal support surface and coupled to the first core section;

a cap configured for supporting the at least one worker and coupled to the second core section;

a cover configured to fit around the core;

a semi-rigid pad between the core and the cover;

wherein the core can be oriented in a first position for a first purpose and a second position for a second purpose.

32. The article of furniture of claim 31 wherein the first core section is a first wedge and the second core section is a second wedge.

33. The article of furniture of claim 31 wherein the first core section is of a generally cylindrical shape and the second core section is of a generally cylindrical shape.

34. The article of furniture of claim 31 wherein the first core section is directly coupled to the second core section.

35. The article of furniture of claim 31 wherein the core further includes an oval shaped cross section.

36. The article of furniture of claim 31 wherein the offset comprises a curved transition.

37. The article of furniture of claim 36 wherein the cap is configured for use as a work surface for supporting an accessory.

38. The article of furniture of claim 36 wherein the cap is configured for supporting the worker and the base is configured to rest on the horizontal surface.

39. The article of furniture of claim 31 wherein the first core section and the second core section are of the same general size and shape.

40. The article of furniture of claim 31 further comprising a handle coupled to the cover for readily repositioning the core within the work environment.

41. The article of furniture of claim 31 further comprising at least one rigid disc attached to the core and a flexible cushion disposed between the core and the rigid disc.

42. The article of furniture of claim 31 wherein the cover is made of a fabric material.

43. The article of furniture of claim 31 wherein the core is constructed of a semi-rigid, lightweight material.

44. The article of furniture of claim 31 wherein the core includes a structural foam.

45. The article of furniture of claim 31 wherein the pad comprises a cushion layer.

46. The article of furniture of claim 45 wherein the pad comprises a covering wrap layer.

47. The article of furniture of claim 46 wherein the pad comprises a foam.

48. The article of furniture of claim 47 wherein the pad is flexible.

49. A multi-purpose article of furniture for use by at least one worker in a work environment having a horizontal support surface such as a floor and at least one vertical support surface such as a wall comprising:

a core formed by a first core section coupled to a second core section at an angular displacement thereby forming an offset between the first core section and the second core section;

a cover configured to fit around the core;

a base configured for resting on the horizontal support surface and coupled to the first core section;

a cap configured for supporting the at least one worker and coupled to the second core section;

wherein the core can be oriented in a first position for a first purpose and a second position for a second purpose.

50. The article of furniture of claim 49 wherein the first core section is a first wedge and the second core section is a second wedge.

51. The article of furniture of claim 49 wherein the first core section is of a generally cylindrical shape and the second core section is of a generally cylindrical shape.

52. The article of furniture of claim 49 wherein the first core section is directly coupled to the second core section.

53. The article of furniture of claim 49 wherein the core further includes an oval shaped cross section.

54. The article of furniture of claim 49 further comprising a semi-rigid pad between the core and the cover.

55. The article of furniture of claim 49 wherein the first core section and the second core section are of the same general size and shape.

56. The article of furniture of claim 49 further comprising a handle coupled to the cover for readily repositioning the core within the work environment.

57. The article of furniture of claim 49 further comprising at least one rigid disc attached to the core and a flexible cushion disposed between the core and the rigid disc.

58. The article of furniture of claim 49 wherein the cover is made of a fabric material.

59. The article of furniture of claim 49 wherein the core is constructed of a semi-rigid, lightweight material.

60. The article of furniture of claim 49 wherein the core includes a structural foam.

61. The article of furniture of claim 49 wherein the cap is configured for use as a work surface for supporting an accessory.

62. The article of furniture of claim 49 wherein the cap is configured for supporting the worker and the base is configured to rest on the horizontal surface.

63. The article of furniture of claim 49 wherein the base comprises a plate.

64. The article of furniture of claim 49 wherein the cap is planar.

65. The article of furniture of claim 64 wherein the cap comprises a lid.

66. The article of furniture of claim 65 wherein the cap includes an end cap.

67. The article of furniture of claim 65 wherein the cap is selectively removable from the core.

68. A multi-purpose article of furniture for use by at least one worker in a work environment having a horizontal support surface such as a floor and at least one vertical support surface such as a wall comprising:

a core formed by a first core section having a shape coupled at an angular displacement to a second core section having a shape of the same general size and shape as the shape of the first core section whereby an offset is formed between the first core section and the second core section;

a base configured for resting on the horizontal support surface;

an end cap coupled to the second core section;

a cover configured to fit around the core;

wherein the core can be oriented in a first position for a first purpose and a second position for a second purpose.

69. The article of furniture of claim 68 wherein the first core section is a first wedge and the second core section is a second wedge.

70. The article of furniture of claim 68 wherein the first core section is of a generally cylindrical shape and the second core section is of a generally cylindrical shape.

71. The article of furniture of claim 68 wherein the first core section is directly coupled to the second core section.

72. The article of furniture of claim 68 wherein the core further includes a face having an oval shaped cross section.

73. The article of furniture of claim 68 further comprising a semi-rigid pad between the core and the cover.

74. The article of furniture of claim 68 further wherein the offset comprises a curved transition.

75. The article of furniture of claim 74 wherein the cap is configured for use as a work surface for supporting an accessory.

76. The article of furniture of claim 74 wherein the cap is configured for supporting the worker and the base is configured to rest on the horizontal surface.

77. The article of furniture of claim 68 further comprising a handle coupled to the cover for readily repositioning the core within the work environment.

78. The article of furniture of claim 68 further comprising at least one rigid disc attached to the core and a flexible cushion disposed between the core and the rigid disc.

79. The article of furniture of claim 68 wherein the cover is made of a fabric material.

80. The article of furniture of claim 68 wherein the core is constructed of a semi-rigid, lightweight material.

81. The article of furniture of claim 68 wherein the core includes a structural foam.

82. The article of furniture of claim 68 wherein the size of the core is configured for supporting the worker.

83. The article of furniture of claim 68 wherein the shape of the first core section is oval.

84. The article of furniture of claim 68 wherein the shape of the first core section is generally cylindrical.

85. The article of furniture of claim 68 wherein the shape of the first core section is elongate.

86. The article of furniture of claim 68 wherein the shape of the first core section is wholly circular.

87. The article of furniture of claim 68 wherein the shape of the first core section is partially circular.

88. A multi-purpose article of furniture configured for supporting an accessory for use by at least one worker in a work environment having a horizontal support surface such as a floor and at least one vertical support surface such as a wall comprising:

a core formed by a first core section coupled to a second core section at an angular displacement whereby an offset is formed between the first core section and the second core section;

a base configured for resting on the horizontal support surface and coupled to the first core section;

a cap configured for supporting the at least one worker and coupled to the second core section;

a cover configured to fit around the core;

wherein the core is configured to be oriented in a first position for a first purpose and a second position for a second purpose.

89. The article of furniture of claim 88 wherein the first core section is a first wedge and the second core section is a second wedge.

90. The article of furniture of claim 88 wherein the first core section is of a generally cylindrical shape and the second core section is of a generally cylindrical shape.

91. The article of furniture of claim 88 wherein the first core section is directly coupled to the second core section.

92. The article of furniture of claim 88 wherein the core further includes an oval shaped cross-section.

93. The article of furniture of claim 88 further comprising a semi-rigid pad between the core and the cover.

94. The article of furniture of claim 88 wherein the offset comprises a curved transition.

95. The article of furniture of claim 88 wherein the first core section and the second core section are of the same general size and shape.

96. The article of furniture of claim 88 further comprising a handle coupled to the cover for readily repositioning the core within the work environment.

97. The article of furniture of claim 88 further comprising at least one rigid disc attached to the core and a flexible cushion disposed between the core and the rigid disc.

98. The article of furniture of claim 88 wherein the cover is made of a fabric material.

99. The article of furniture of claim 88 wherein the core is constructed of a semi-rigid, lightweight material.

100. The article of furniture of claim 88 wherein the core includes a structural foam.

101. The article of furniture of claim 88 wherein core in the first position is configured to support at least one of the worker and the accessory.

102. The article of furniture of claim 101 wherein the core in the second position is configured to rest on the horizontal surface.

103. The article of furniture of claim 88 wherein the core includes a transition portion.

104. The article of furniture of claim 103 wherein the core has an angular profile.

105. The article of furniture of claim 104 wherein the first core section is offset from the second core section.

106. The article of furniture of claim 105 wherein the core comprises an oblique portion.

107. The article of furniture of claim 88 wherein the core comprises a curved portion.

108. The article of furniture of claim 88 wherein the core comprises a bent portion.

109. The article of furniture of claim 88 wherein the core is solid.

110. The article of furniture of claim 88 wherein the core is hollow.

111. The article of furniture of claim 110 wherein the core is at least partially partitioned.

112. The article of furniture of claim 88 further comprising a pocket coupled to the core.

113. The article of furniture of claim 88 wherein the cover includes a functional surface treatment.

114. The article of furniture of claim 88 wherein the cover includes a decorative surface treatment.

* * * * *